US006345846B1

(12) United States Patent
DeRees et al.

(10) Patent No.: US 6,345,846 B1
(45) Date of Patent: Feb. 12, 2002

(54) VEHICLE OVERCENTER LATCH ASSEMBLY

(75) Inventors: Delbert D DeRees, Romeo; Patrick J O'Mahoney, West Bloomfield, both of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/465,651

(22) Filed: Dec. 17, 1999

(51) Int. Cl.[7] ..... E05C 3/04

(52) U.S. Cl. ..... 292/241; 292/DIG. 49; 292/66

(58) Field of Search ..... 292/241, 66, 113, 292/97, DIG. 49

(56) References Cited

U.S. PATENT DOCUMENTS

| | | | | | |
|---|---|---|---|---|---|
| 1,442,369 | A | | 1/1923 | Sweet | |
| 2,703,431 | A | * | 3/1955 | Tatom | 16/147 |
| 2,867,863 | A | * | 1/1959 | Webb | 20/92 |
| 3,021,162 | A | | 2/1962 | Jahn | |
| 3,162,419 | A | | 12/1964 | Blasingame | |
| 3,400,963 | A | * | 9/1968 | Jablonski | 292/247 |
| 3,628,817 | A | | 12/1971 | Sheahan | |
| 3,706,467 | A | * | 12/1972 | Martin | 292/111 |
| 3,985,380 | A | * | 10/1976 | Raivio | 292/69 |
| 4,218,081 | A | | 8/1980 | Johnson | |
| 4,307,906 | A | | 12/1981 | Schenk | |
| 4,602,812 | A | | 7/1986 | Bourne | |
| 4,679,833 | A | * | 7/1987 | Dueringer | 292/113 |
| 4,801,165 | A | | 1/1989 | Pyle | |
| 5,024,471 | A | * | 6/1991 | Kahl | 292/97 |
| 5,452,926 | A | | 9/1995 | Takimoto | |
| 5,478,125 | A | | 12/1995 | Gromotka | |
| 5,624,142 | A | | 4/1997 | Watson et al. | |

* cited by examiner

*Primary Examiner*—Gary Estremsky
(74) *Attorney, Agent, or Firm*—Mark P. Calcaterra

(57) ABSTRACT

An overcenter latch assembly for securing a moveable member including a bracket secured to a first member and a saddle secured to a second member in opposed relation to the bracket. The saddle includes longitudinally spaced apart, transversely extending recesses formed thereon. Each recess is formed with a transversely extending raceway ending in opposed inboard and outboard pivot sockets. A release cover is pivotally connected to the bracket. The release cover has a member pivotally secured thereon. The pivoting member has opposed extensions adapted to be received in the inboard pivot socket of the recess for pivotal movement of the release cover about an inboard axis in a latching direction from an initial unlatched position. The raceways are oriented in the direction substantially perpendicular to a longitudinal axis of the release cover with the release cover in an unlatched to latched position such that initially rotating the release cover in a latching direction pivots the release cover about the inboard axis through a predetermined first angle so as to cause downward force on the saddle via the extensions such that continued rotation causes the extensions to travel to an outboard position on the raceways and to seat in associated outboard sockets. Continued rotation of the release handle about an outboard axis to the latch position causes the release cover to travel to a predetermined locked position. The locked position has an overcentered length resulting in reduced effort to latch the assembly.

10 Claims, 4 Drawing Sheets

VEHICLE OVERCENTER LATCH ASSEMBLY

FIELD OF THE INVENTION

This invention relates generally to overcenter latches for securing movable members, and more particularly to an overcenter latch having solid mechanical components for "positive" overcenter engagement.

DISCUSSION

It is well known in the art to use overcenter latches which predominantly include an elastomeric tension link for securing movable members including hood members for off-road or sport utility vehicles. One example of this is U.S. Pat. No. 5,624,142 issued Apr. 29, 1997 to Watson et al., entitled "Vehicle Overcenter Closure Latch". The Watson patent discloses an overcenter latch for releasably securing a closure to a body panel including an elastomeric link pivotally connected between a body panel bracket and an operating handle. The handle has a pair of laterally spaced apart prongs terminating in arcuate cams adapted for engagement with associated fore and aft transversely extending recesses formed in a closure striker block. Each recess includes a raceway terminating in opposed inboard and outboard pairs of pivot sockets, wherein the inboard and outboard sockets define respective inboard and outboard pivot axes. In the Watson patent as in other overcenter latches which include an elastomeric tension link, the link is tensed when operating the latch therein resulting in the link being placed under tension such that it is the tension in the link which holds a hood, for example, in a latched position. Such prior latches have negative limitations in that the elastomeric tension link member is subject to failure after prolonged use and exposure to environmental conditions.

It is therefore desirable to provide a system which alleviates the above-referenced negative limitations, and further provide a positive lock/hold-down feature through the use of solid mechanical components.

SUMMARY OF THE INVENTION

Accordingly, it is an object of the present invention to provide a vehicle overcenter latch assembly having solid mechanical components. It is a further object of the present invention to provide a vehicle overcenter latch assembly having positive overcenter engagement.

These and other objects and advantages of the invention are obtained by providing an overcenter latch assembly for securing a moveable member including a bracket secured to a first member and a saddle secured to a second member in opposed relation to the bracket. The saddle includes longitudinally spaced apart, transversely extending recesses formed thereon. Each recess is formed with a transversely extending raceway ending in opposed inboard and outboard pivot sockets. A release cover is pivotally connected to the bracket. The release cover has a member pivotally secured thereon. The pivoting member has opposed extensions adapted to be received in the inboard pivot socket of the recess for pivotal movement of the release cover about an inboard axis in a latching direction from an initial unlatched position. The raceways are oriented in the direction substantially perpendicular to a longitudinal axis of the release cover with the release cover in an unlatched to latched position such that initially rotating the release cover in a latching direction pivots the release cover about the inboard axis through a predetermined first angle so as to cause downward force on the saddle via the extensions such that continued rotation causes the extensions to travel to an outboard position on the raceways and to seat in associated outboard sockets. Continued rotation of the release handle about an outboard axis to the latch position causes the release cover to travel to a predetermined locked position. The locked position has an overcentered length resulting in reduced effort to latch the assembly.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict an illustrated embodiment of the present invention and are not therefore to be considered limiting in scope, the invention will be described and explained with additional specificity and detail through use of the accompanying drawings in which.

DETAILED DESCRIPTION OF THE PREFERRED EMBODIMENTS

Figure 1:
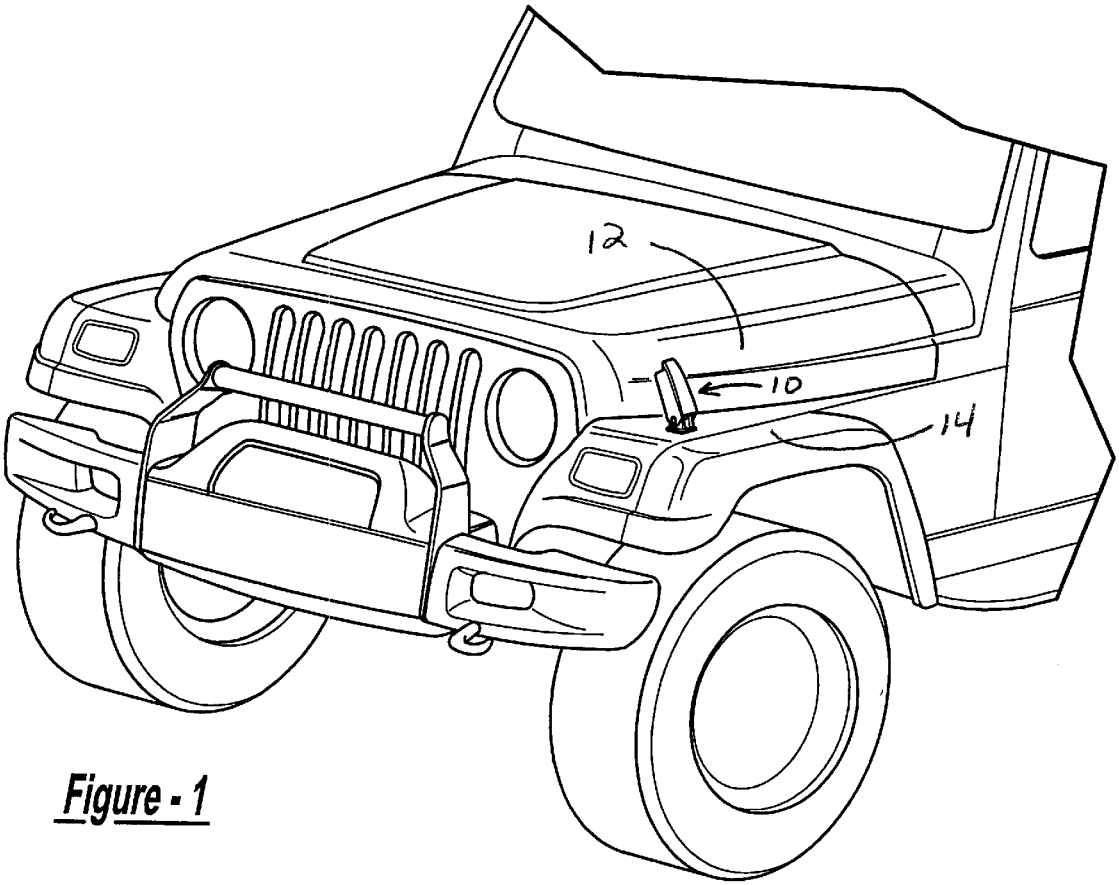
FIG. 1 is a fragmentary perspective view of a vehicle body left hand side front end portion showing an exterior vehicle overcenter latch assembly according to the principles of the present invention.

The present invention is directed toward a vehicle overcenter latch assembly 10 for use with a vehicle as generally shown in FIG. 1. As illustrated in FIG. 1, the vehicle overcenter latch assembly 10 is shown in a closed position wherein a hood member 12 is positively held down against a fender 14, therein securing the hood member 12 for covering the vehicle engine compartment. The hood 12 is secured by a pair of vehicle overcenter latch assemblies 10, one on the right and left sides, with only the left side being shown in FIG. 1. The present invention as hereinafter detailed should not be interpreted as limiting the breadth of potential uses in other vehicles or potentially in other applications for other intended purposes.

Figure 2:
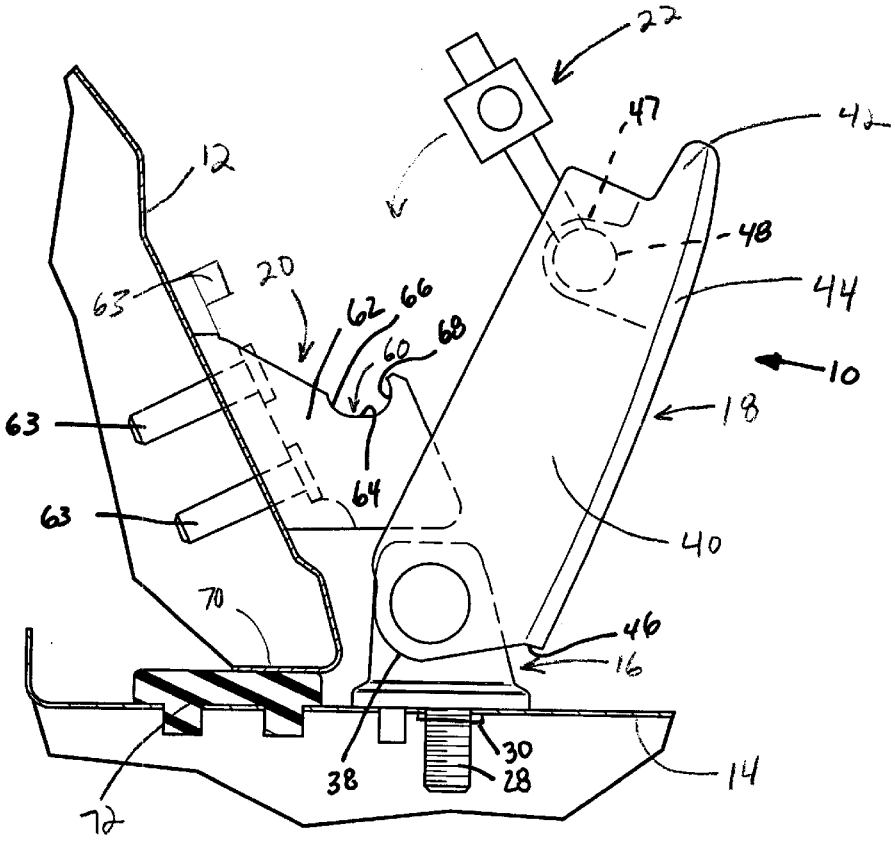
FIG. 2 is a side view of the vehicle overcenter latch assembly in its open position with the latch handle rotated clockwise to a non-engaged position according to the principles of the present invention.

The vehicle overcenter latch assembly 10 in accordance with the illustrated embodiment of FIG. 2 has a base 16, a release cover 18, a saddle bracket 20 and an adjustable eyebolt assembly 22. The base 16 is mounted to a fender 14, and the saddle bracket 20 is mounted to a hood 12. The release cover 18 at one end is pivotally mounted to the base 16. The adjustable eyebolt assembly 22 is pivotally mounted to the release cover 18. The adjustable eyebolt assembly 22 can be rotated downward such that it engages the saddle bracket 20 when the release cover 18 is rotated from an unlatched position to a latched position, therein positively holding down the hood 12 for operation of the vehicle. A more detailed description of the various components of the vehicle overcenter latch assembly 10 will be described below.

Figure 4:
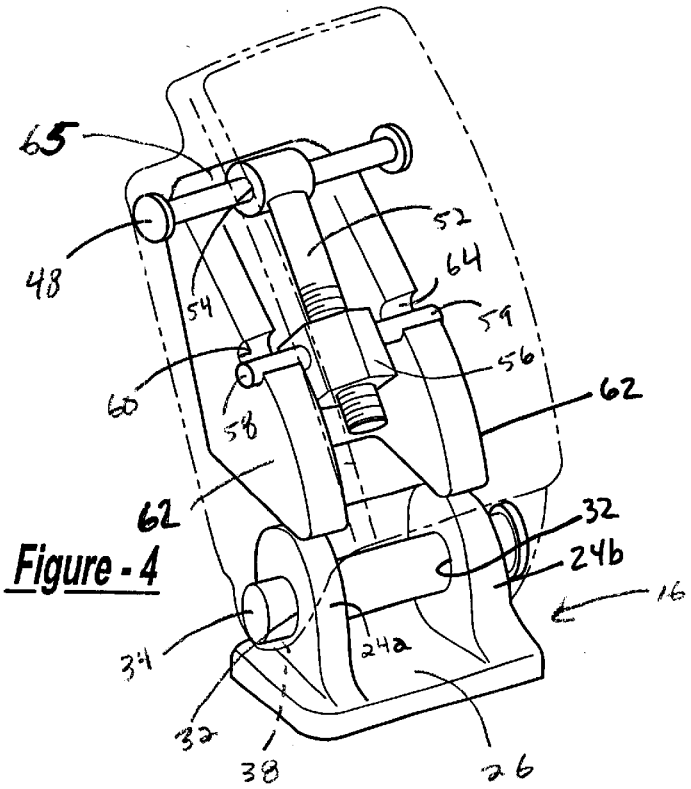
FIG. 4 is a perspective view of the vehicle overcenter latch assembly in the closed position according to the principles of the present invention.
Figure 3:
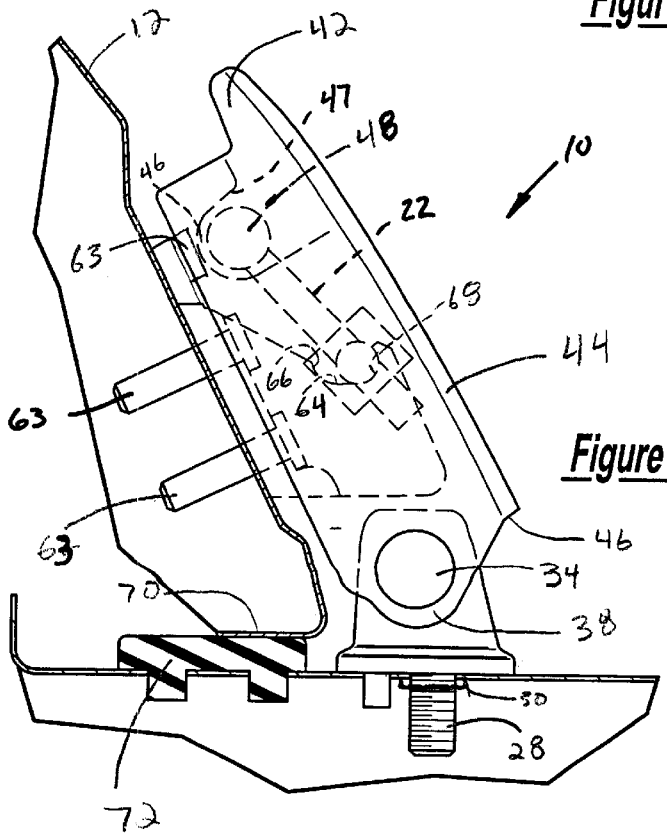
FIG. 3 is a side view of the vehicle overcenter latch assembly in the closed position according to the principles of the present invention.

Turning to FIGS. 2, 3 and 4, the base 16 of the vehicle overcenter latch assembly 10 includes a U-shaped portion 24 (FIG. 4) of a structural material (either cast or molded) having upwardly extending arm portions 24*a*, 24*b* extending from a base portion 26 secured by a bolt 28 extending into the fender 14 and retained by a nut 30. The arm portions 24*a*, 24*b* each have a longitudinally extending aperture 32 (FIG. 4) which are designed to receive a longitudinally extending lower pivot pin 34. The lower pivot pin 34 defines a longitudinally extending lower pivot axis 36 (see FIG. 6). The base 16 and more particularly the lower pivot pin 34 is adapted to rotatably support the release cover 18 which is hereunder described in more detail.

Returning to FIGS. 2, 3 and 4, the release cover 18 includes a pair of apertured ears 38 (FIG. 4) adapted to pivotally mate with the lower pivot pin 34 for rotation of the release cover 18. The release cover 18 further includes a body portion 40 having an operating handle 42 and an exterior cover 44. The exterior cover 44 terminates at a stop 46 which is designed to engage the base 16 at a predetermined point when the release cover 18 is in the unlatched position. The release cover 18 also includes a pair of apertured blocks 47 adapted for receiving a longitudinally extending upper pivot pin 48 defining a longitudinally extending upper pivot axis 50 (see FIG. 6). The upper pivot pin 48 rotatably supports the eyebolt assembly 22 which is hereunder described. Returning to FIGS. 2, 3 and 4, as best seen in FIG. 4, the eyebolt assembly 22 includes an eyebolt 52 having an annular eye 54. The eyebolt assembly 22 also includes an adjuster nut 56 having opposed cylindrical extensions 58 and 59. The eyebolt assembly 22 is adapted such that the annular eye 54 of the eyebolt 52 receives the upper pivot pin 48 while nesting in the recess between blocks 47 (FIGS. 2 and 3) of the release cover 18. The eyebolt assembly 22 can pivot a minimum of 180° such that when the release cover 18 is in an unlatched position the eyebolt assembly 22 can pivot about upper pivot pin 48 as reflected in FIG. 2. The cylindrical extensions 58 and 59 of the adjuster nut 56 are adapted to be received in an associated pair of fore and aft laterally spaced apart recesses, generally indicated as 60 in FIGS. 2 and 4. Each recess 60 is formed in an associated portion of a pair of laterally spaced apart side walls 62 of the U-shaped saddle bracket 20. The saddle bracket 20 is described more specifically described hereunder.

Returning to FIGS. 2, 3 and 4, the saddle bracket 20 is secured by a pair of lower bolts 63 extending through the hood 12. The lower bolts 63 are received in associated threaded bores of a backing plate (not shown) welded to the hood inner surface. The saddle bracket 20 is formed with an upstanding stop tab 65. The stop tab 65 is adapted to be contacted by the eyebolt 52 at a point where the upper pivot pin 48 is retained in the annular eye 54 of the eyebolt 52. The stop tab 65 is thus positioned in contact with the eyebolt 52 when the release cover 18 is rotated to its latched position, therein the release cover 18 is prevented from striking the saddle bracket 20 or the hood 12. As described earlier, each recess 60 of the saddle bracket 20 is formed in an associated upper edge portion of a pair of laterally spaced apart walls 62 of U-shaped saddle bracket 20. Each upwardly opening elongated recess 60 defines a transversely extending planar raceway 64 of predetermined extent. Each raceway 64 terminates in opposed inboard 66 and outboard 68 pivot sockets (FIG. 3). The pair of opposed inboard and outboard pivot sockets 66 and 68 are each sized for pivotal seating of the cylindrical extensions 58 in a manner to be described.

Figure 7:
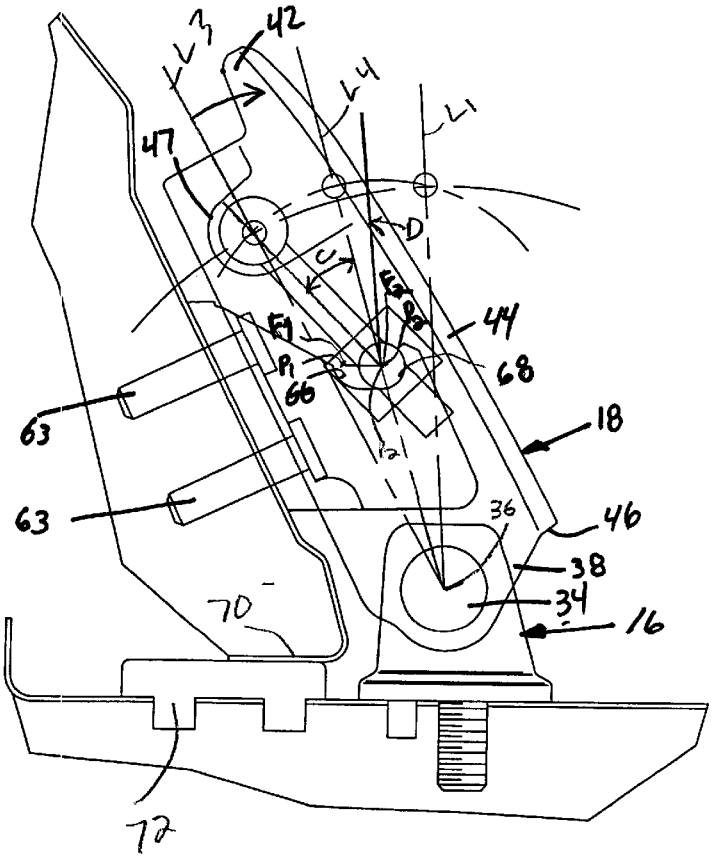
FIG. 7 is a view similar to FIG. 6 showing the unlatching sequence of the vehicle overcenter latch assembly according to the principles of the present invention.

Referring to FIG. 7 it will be seen that the inboard pivot socket 66 is defined by a center of pivot "P1" about which a predetermined radius of curvature "R" generates a concave semi-cylindrical surface of the socket 66. It will be appreciated that the radius of curvature of the cylindrical extension 58 has the same dimension as the inboard pivot socket radius of curvature. Consequently with a pair of cylindrical extensions 58 seated in their associated inboard sockets 66, the eyebolt 52 is adapted for pivotal movement about a longitudinal extending inboard pivot axis "F1" which includes fore and aft pivot point centers "P1".

Figure 6:
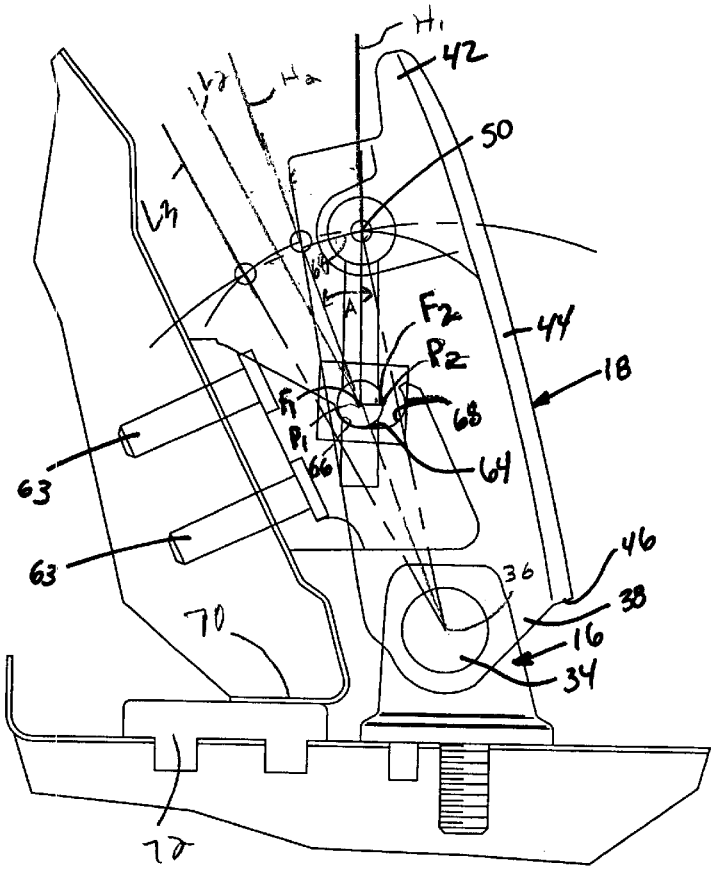
FIG. 6 is an enlarged partially diagrammatic fragmentary sectional view of the vehicle overcenter latch assembly showing the latching sequence according to the principles of the present invention.

With reference to FIG. 6, each outboard pivot socket 68 is defined by an outboard center pivot "P2" which has the same radius of curvature as each inboard pivot socket 66. Thus, upon the cylindrical extensions 58 being pushed outboard on their associated raceway 64 from the inboard pivot socket 66 to seat in the outboard socket 68 the eyebolt 52 is adapted to pivot about an outward longitudinally extending pivot axis "F2".

Figure 5:
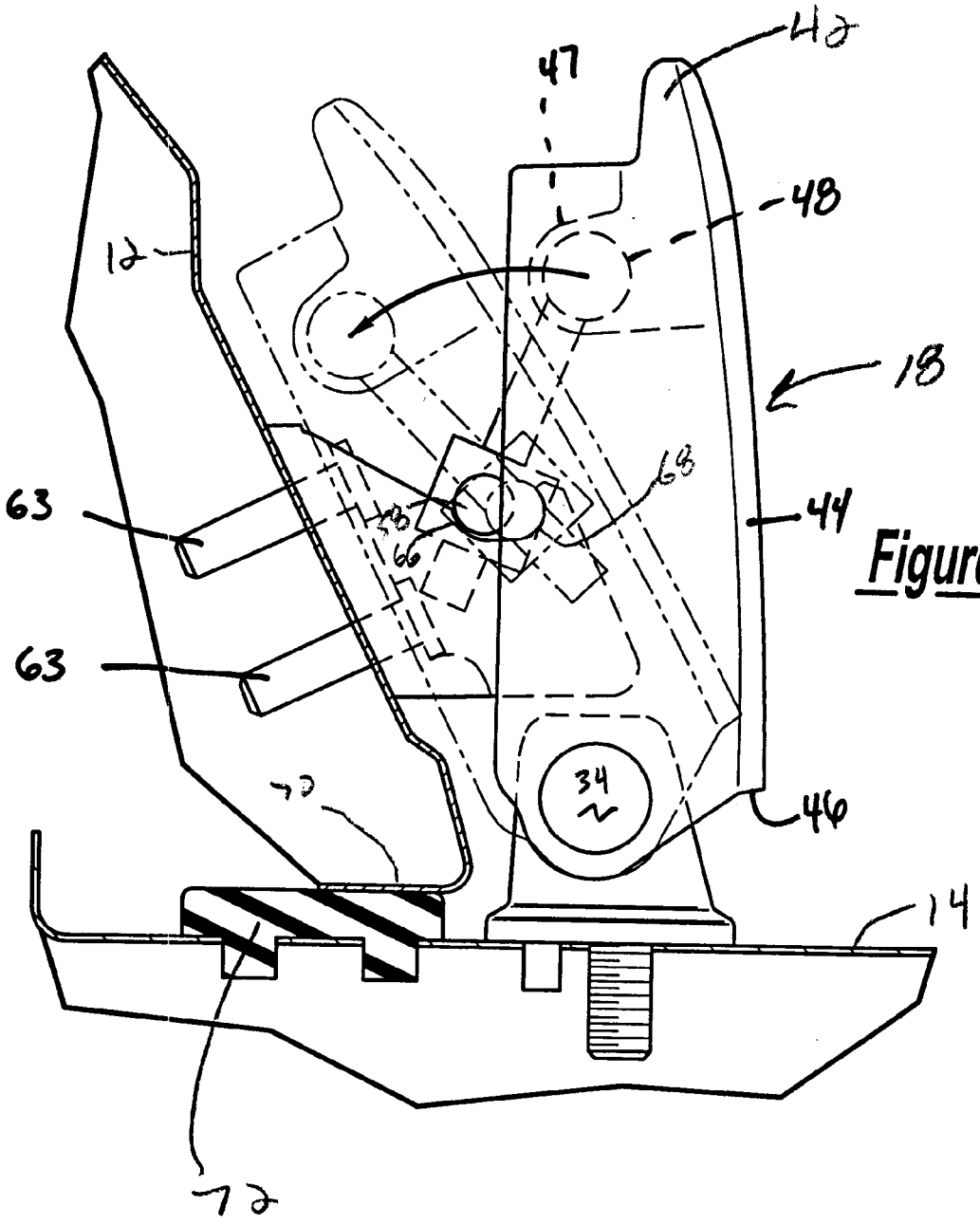
FIG. 5 is a side view of the vehicle overcenter latch assembly illustrating the operation of the overcenter latch assembly according to the principles of the present invention.

Turning now to the method of operation, FIG. 2 shows the hood 12 and the fender 14 adapted to be latched, with the saddle bracket 20 in opposed relation to the base 16. In the disclosed embodiment, upon closure of the hood 12 each side of turned in flange 70 is positioned over an associated fender 14 for engagement with a rubber bumper 72. With the release cover 18 spaced from the saddle bracket 20, the eyebolt assembly 22 and release cover 18 are swung counter-clockwise into initial engagement, indicated in FIG. 5. With reference to FIG. 5, the cylindrical extensions 58 are shown seated in their associated inboard sockets 66, with the release cover 18 adapted to pivot counter-clockwise about inboard longitudinal pivot axis in the direction of the arrow. In FIG. 6 the release cover 18 is shown rotated counter-clockwise through a predetermined angle "A", from its initial radial line "H1" to a handle overcenter position, indicated by radial line "H2". It will be seen that during its travel through angle "A" the release cover pivot in axis 50 follows an arcuate path 74, wherein the eyebolt assembly 22 via the adjuster nut 56 and more particularly the cylindrical extensions 58 apply a downward pressure on inboard socket 66 which therein applies pressure onto rubber bumper 72 via flange 70.

It will be noted in FIG. 6 that the release cover 18 overcentered line "H2" defines a radially extending plane which intersects the plane of raceway 64 at an angle of substantially 90°. As a result of the pressure placed on cylindrical extension 58 and therein inboard socket 66 as the release cover 18 is rotated through the overcenter position to a latched position, the eyebolt assembly 22 via the cylindrical extensions 58 is pushed outboard on the associated raceways 64, i.e. the cylindrical extensions 58 translate from their inboard sockets 66 to their outboard sockets 68. The operator continues rotating the release cover 18 about the outboard pivot axis "F2", thereby causing the eyebolt assembly 22 to swing through its theoretical link overcenter line "L2" to its latched position, indicated by line "L3". FIG. 6 shows the theoretical overcenter line "L2" defining a radial plane that includes axial bracket pivot axis 36, inboard pivot axis "P1", and release cover pivot axis 50.

With reference to FIG. 6 it will be seen that upon the cylindrical extensions 58 being translated to their outboard pivot sockets 68, the handle pin moves from its overcenter line "H2" to the overcenter line "L3". In the latched mode the cylindrical extensions 58 apply downward pressure to a predetermined extent to resiliently retain release cover 18 and eyebolt assembly 22 in their "L3" overcenter latched position. With reference to FIG. 7, the release cover 18 is shown in FIGS. 3 and 5 in its latched mode with the cylindrical extensions 58 shown seated in their associated outboard pockets 68, wherein the release cover 18 is adapted for initial pivotal clockwise unlatched movement about outboard longitudinal axis "P2" (FIG. 12) in the direction of the arrow. Referring to FIG. 7 the release cover 18 is rotated through a predetermined angle "C" from line "L3" to the theoretical overcentered line "L4" defining a plane which includes the lower pin axis 36 and the outboard axis "F2". It will be noted in FIG. 7 that the overcentered line "L4" defines a radially extending plane which intersects the plane of the raceways 64 at a predetermined angle. As the predetermined angle is less than the required 90°, the release cover must rotate through angle "D" before the cylindrical extensions 58 snap inboard on the raceways 64 to their associated inboard pivot sockets 66. Thus, during unlatching, as the release cover 18 rotates beyond the overcenter line "L4", the eyebolt 52 is pulled through the theoretical overcenter position, therein reducing the effort required for unlatching. In turn, it is the amount of force required to pull the release cover 18 through the overcenter position that ensues against inadvertent unlatching of the hood 12.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and the following claims.

What is claimed is:

1. An overcenter latch assembly adapted for securing a pair of relatively movable members together comprising:

a bracket secured to one member;

a saddle secured to a second member in opposed relation to said bracket, said saddle having longitudinally spaced apart, transversely extending recesses formed thereon, each recess formed with a transversely extending raceway ending in opposed inboard and outboard pivot sockets; and a release cover pivotally connected to said bracket, said release cover having an adjustable member pivotally secured thereon, said adjustable member having opposed extensions adapted to be received in said inboard pivot socket of said recess for pivotal movement of said release cover about an inboard axis in a latching direction from an initial unlatched position, said raceways being oriented in the direction substantially perpendicular to a longitudinal axis of the release cover with the release cover in an unlatched to latched position such that initially rotating said release cover in a latching direction pivots said release cover about said inboard axis through a predetermined first angle so as to cause a compressive force on said saddle via said extensions such that continued rotation causes said extensions to travel to an outboard position on the raceways and to seat in associated outboard sockets, whereby continued rotation of said release handle about an outboard axis to said latch position causes said release cover to travel to a predetermined locked position, said locked position having an overcentered length resulting in reduced effort to latch said assembly.

2. The overcenter latch assembly according to claim 1, wherein rotating said release cover in an unlatching direction from a latched position, pivots said release cover about said outboard access through a predetermined second angle determined by said raceway orientation to a second overcenter position greater than the first overcenter position, thereby increasing the unlatching effort required to cause said extensions to move inboard on the respective raceways and to seat in the associated inboard sockets, such that continued rotation results in said release cover rotating about said inboard access and returning to an unlatched position.

3. The overcenter latch assembly according to claim 1 wherein said adjustable member further comprises an eyebolt having an annular eye which is in pivotal rotation with said release cover, said adjustable member carrying said opposed extensions such that said adjustable member can move about said eyebolt such that rotation of said adjustable member results in changes in the amount of latching force required to rotate said release cover from a latched to an unlatched position.

4. The overcenter latch assembly according to claim 1 further comprising said saddle having a compressible mount and wherein the pivotal rotation of said release cover from a latched to an unlatched position results in a downward force being formed by said adjustable member, the downward force being applied by said adjustable member on said compressible mount, said compressible mount adjacent said adjustable member.

5. The overcenter latch assembly according to claim 1 further comprising said adjustable member having a threaded portion.

6. The overcenter latch assembly according to claim 1 further comprising at least one of said opposed extensions being adjacent to a nut, said nut engaging said adjustable member.

7. The overcenter latch assembly according to claim 1 further comprising said adjustable member having second opposed extensions to be pivotally received in said release cover.

8. The overcenter latch assembly according to claim 1 further comprising said release cover having longitudinally spaced apart, transversely extending second recesses, each of said second receives formed with a transversely extending raceway in opposed inboard and outboard second pivot sockets.

9. The overcenter latch assembly according to claim 1 further comprising said adjustable member having a second opposed extensions to engage said second pivot sockets.

10. The overcenter latch assembly according to claim 1 further comprising said release cover is longitudinally extending at least the length of said adjustable member.

* * * * *